United States Patent [19]

Heath et al.

[11] Patent Number: 4,474,550

[45] Date of Patent: Oct. 2, 1984

[54] THERMOSTATIC CONTROL SYSTEM

[76] Inventors: Rodney T. Heath, 4901 E. Main, Farmington, N. Mex. 87401; Charles R. Gerlach, 639 W. Rhapsody, San Antonio, Tex. 78216

[21] Appl. No.: 359,246

[22] Filed: Mar. 18, 1982

[51] Int. Cl.[3] ..... F23N 1/00

[52] U.S. Cl. ..... 431/18; 431/58; 236/80 R; 236/87

[58] Field of Search ..... 431/58, 83, 18; 137/468, 82; 236/92 A, 86, 87, 80 R, 33

[56] References Cited

U.S. PATENT DOCUMENTS

| | | | |
|---|---|---|---|
| 1,467,049 | 9/1923 | Long | 431/58 |
| 2,158,787 | 5/1939 | Lorenz et al. | 236/92 A |
| 2,626,753 | 1/1953 | Merrill | 236/87 |
| 3,135,495 | 6/1964 | Ferris | 236/86 |
| 3,212,711 | 10/1965 | Kaminski | 236/87 |
| 3,313,485 | 4/1967 | Harvey | 236/86 |
| 3,360,198 | 12/1967 | Katchka | 236/80 |
| 3,848,622 | 11/1974 | Cummings | 137/468 |

*Primary Examiner*—Samuel Scott

*Assistant Examiner*—Allen J. Flanigan

*Attorney, Agent, or Firm*—Klaas & Law

[57] ABSTRACT

A system for controlling the amount of natural supply gas delivered from a natural gas supply source to a natural gas burner adapted to continually heat a process fluid in a vessel and for enabling the gas burner to continuously automatically maintain the temperature of the process fluid within a predetermined minimum range of temperatures above and below a preset nominal temperature. The system comprises a gas operated flow regulator device associated with a supply gas line connected to the gas burner for regulating the amount of gas delivered to the gas burner in accordance with pressure of regulator control gas delivered to the flow regulator device through a control gas line, gas pressure control apparatus associated with the control gas line for varying the pressure of the control gas delivered to the flow regulator device; and a linearly movable temperature sensing device operable by process fluid temperature and connected to the gas pressure control apparatus to vary the control gas pressure.

12 Claims, 7 Drawing Figures

THERMOSTATIC CONTROL SYSTEM

BACKGROUND OF THE INVENTION

This invention relates to thermostatic control systems and, more particularly, to a thermostatically operated gas control system for controlling the amount of fuel gas supplied to a gas burner associated with natural gas and oil processing equipment.

Equipment used for the production and processing of liquid and gaseous petroleum products often incorporates a burner for heating of the produced fluid and/or some other process fluid. These burners consume fuel gas, most often natural gas available at the site, as the source of heat energy. For example, a dehydrator such as shown in U.S. Pat. Nos. 3,094,574; 3,288,448 and 3,541,763, may be located near the well head of a producing gas well to remove water vapor from the gas before it is introduced into the transmission line. Failure to dehydrate natural gas from wells in freezing weather often results in production lines which are plugged with ice; hence, gas dehydration in many areas, particularly in winter, is a necessity. Some fuel gas must be consumed in the dehydration process and the amount consumed represents a reduction in the quantity available for sale. Any reduction in the quantity of fuel gas required for dehydration or other production processes represents an energy savings.

The present invention provides a means of significantly reducing the fuel gas requirement where burners are employed as a heat source in liquid and gaseous petroleum production, and more generally, where burners may be employed in other processes.

In a typical system used for the heating of some process fluid in oil and gas production equipment, the process fluid is contained, while being heated, in a vessel through which the fluid flows. The heating is accomplished by heat transfer from a fire tube heated from within by the products of combustion of fuel gas (mostly methane) and air. Primary air and fuel gas are combined in the burner mixer and discharged through the burner tip. This initial fuel-air mixture is then combined with additional air and burned in the combustion zone of the fire tube. The burner is mounted within a burner housing with the tip protruding into the fire tube. Air enters the burner housing through a flash arrestor. The products of combustion exit the system through a stack. The differential pressure necessary to draw air through the flash arrestor into the burner housing plus ovvercome friction loss in the fire tube and stack is provided by the combined effect of the stack draft and the momentum increase of the gases in the burning zone.

Control of the temperature of the process fluid is achieved with a thermostat and motor valve which regulate the pressure of the fuel gas supplied to the burner. Two types of thermostat/motor valve actions may be employed. One is a "snap" action wherein the burner gas pressure is either $P_s$ (full regulated supply pressure) or zero (fully off). With this action, a small increase in the process fluid temperature above the set point temperature results in closure of the motor valve, hence zero burner supply pressure. Alternately, a small decrease in process fluid temperature below the set point results in full opening of the motor valve, hence full supply pressure to the burner. The burner is, therefore, alternately fully on or fully off in maintaining a nominal set temperature.

A second type of thermostat/motor valve action is termed "throttling" and results in a burner supply pressure which is continually regulated to hold the set temperature. With this action, the burner supply pressure generally holds approximately constant with time unless the heat load of the system changes because of a change in atmospheric conditions or a change in the flow rate of the process fluid. The throttling type thermostat/motor valve action is generally preferred since it is more efficient and saves energy. A throttling thermostat/motor valve action, when used in gas dehydration, can result in an indirect but particularly significant gas savings. This savings occurs because first with a throttled burner, all or a portion of the gas consumed by the glycol pump employed on the dehydrator can be directed to the burner as fuel gas. In the past no satisfactory thermostat has been available to achieve the control required to maintain a throttled burner action on, for example, a natural gas dehydration unit. In addition, with a snap acting thermostat, the burner is fired at a much higher heating rate than is required to maintain the process temperature resulting in higher stack temperatures and heat energy losses, and during the off cycle of the burner, cold air is drafted through the fire tube creating additional energy losses.

The present invention is a system for controlling the amount of natural supply gas delivered from a natural gas supply source to a natural gas burner adapted to continuously heat a process fluid and for enabling the gas burner to continuously automatically maintain the temperature of the process fluid within a predetermined minimum range of temperatures above and below a pre-set nominal temperature. The system comprises a gas operated regulator means associated with a main supply gas line connected to the gas burner for regulating the amount of supply gas delivered to the gas burner is accordance with the pressure of control gas delivered to the regulator means from a control gas line; a thermostatically operated valve means associated with the control gas line for controlling the pressure of control gas to the gas operated regulator means including a first small fixed size orifice and a second variable size orifice which provide control gas venting means for reducing and increasing the pressure of the control gas in the gas operated regulator means; and temperature responsive linearly movable control means operable in response to changes in the process fluid temperature and being operably associated with the control gas venting means for continuously variably controlling the pressure of control gas in the valve means in accordance with the temperature of the process fluid whereby the pressure of supply gas delivered to the burner is increased when process fluid temperature falls below the set nominal temperature and is decreased when process fluid temperature rises above the set nominal temperature.

BRIEF DESCRIPTION OF DRAWING

An illustrative and presently preferred embodiment of the invention is shown in the accompanying drawing in which:

FIG. 4 is a schematic view of the apparatus of FIG. 1 in association with a gas burner for heating a process fluid in a vessel of a natural gas dehydrating system or the like;

DETAILED DESCRIPTION OF INVENTION

Figure 1:
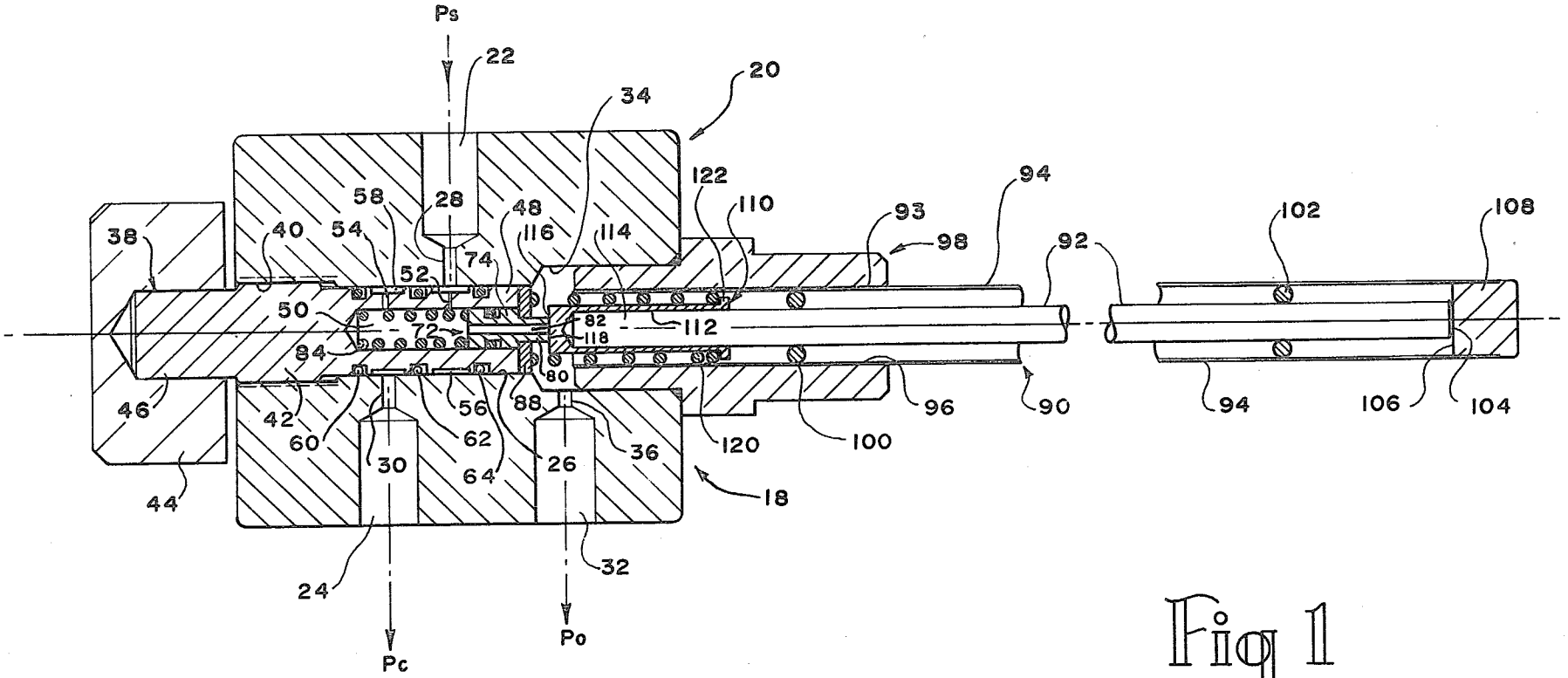
FIG. 1 is a cross-sectional view, with portions removed, of thermostatic throttling-type control apparatus of the present invention.

In general, the control apparatus 18 of the present invention comprises a valve housing means 20 having a supply gas inlet passage 22 containing supply gas at a relatively high pressure, e.g. approximately 15 to 30 psi., and a control gas outlet passage 24 which are connected to a central cylindrical bore 26 by relatively small diameter (e.g. approximately 0.080 inch) passages 28, 30. A gas vent passage 32 is connected to an enlarged counterbore portion 34 of bore 26 by a relatively small diameter (e.g. approximately 0.080 inch) passage 36. A main cylindrical valve stem member 38 is adjustably threadably mounted in a threaded bore portion 40 by a threaded stem portion 42. A hand knob 44 is mounted on stem outer end portion 46 to enable longitudinal adjustment of stem member 38. The inner stem end portion 48 has a central cylindrical bore 50, FIG. 2, which is connected to gas passages 28, 30 by longitudinally spaced passages 52, 54, respectively, and circumferential gas grooves 56, 58, respectively, on the periphery of end portion 48. Inlet passage 52 is of very small diameter, e.g. approximately 0.010 inch, to provide a fixed size orifice between groove 56 and bore 50. Outlet passage 54 may be of substantially larger diameter of approximately 0.040 inch than orifice passage 52. O-ring seals 60, 62, 64 are mounted in peripheral seal grooves 66, 68, 70, FIGS. 2 and 3, respectively, longitudinally adjacent gas grooves 56, 58.

A plunger member 72 has a cylindrical inner end portion 74, slidably mounted in bore 50 with an O-ring seal 76 mounted in a peripheral groove 78, and a cylindrical outer end portion 80 of reduced diameter. A central cylindrical gas passage 82 of relatively large (e.g. 0.100 inch) diameter extends through plunger member 72. A relatively low strength compression spring member 84 is mounted in bore 50 with one end abutting plunger end surface 86 to outwardly bias plunger member 72 into abutting engagement with a washer member 88 mounted on outer end plunger portion 80.

The amount of gas which flows through plunger bore 82 to bore 34 and passages 32, 36 is controlled by linearly movable heat responsive means 90, FIG. 1, comprising an inner cylindrical rod member 92 of a material, such as glass, having a relatively low coefficient of expansion, and an outer cylindrical tube member 94 of a material, such as steel, having a relatively high coefficient of expansion. One end 93 of tube member 94 is fixedly mounted in a cylindrical bore 96 in a coupling member 98 fixedly mounted in bore 34 of housing 20. Rod member 92 is movably supported in tube member 94 by suitable low friction support ring members 100, 102 with outer rod end surface 104 abutting inner end surface 106 of an end plug member 108 fixed in the outer end of tube 94. A sleeve member 110 having a central cylindrical bore 112 is slidably mounted on rod end portion 114 with an end surface 116 adapted to abut plunger end surface 118 to close plunger bore 82 in a non-throttling shut-off condition, FIG. 2, and to be variably spaced therefrom in a control condition during normal operation to define a variable size orifice type passage means between bore 82 and bore 34 for variably controlling the pressure of control gas in bore 50. A compression spring member 120 of relatively high strength is mounted between sleeve member 110 and tube member 94 with one end abutting a sleeve flange portion 122 and the other end abutting washer member 88 mounted circumjacent plunger portion 80 against end surface 126, FIG. 2, of stem member 38.

Figure 2:
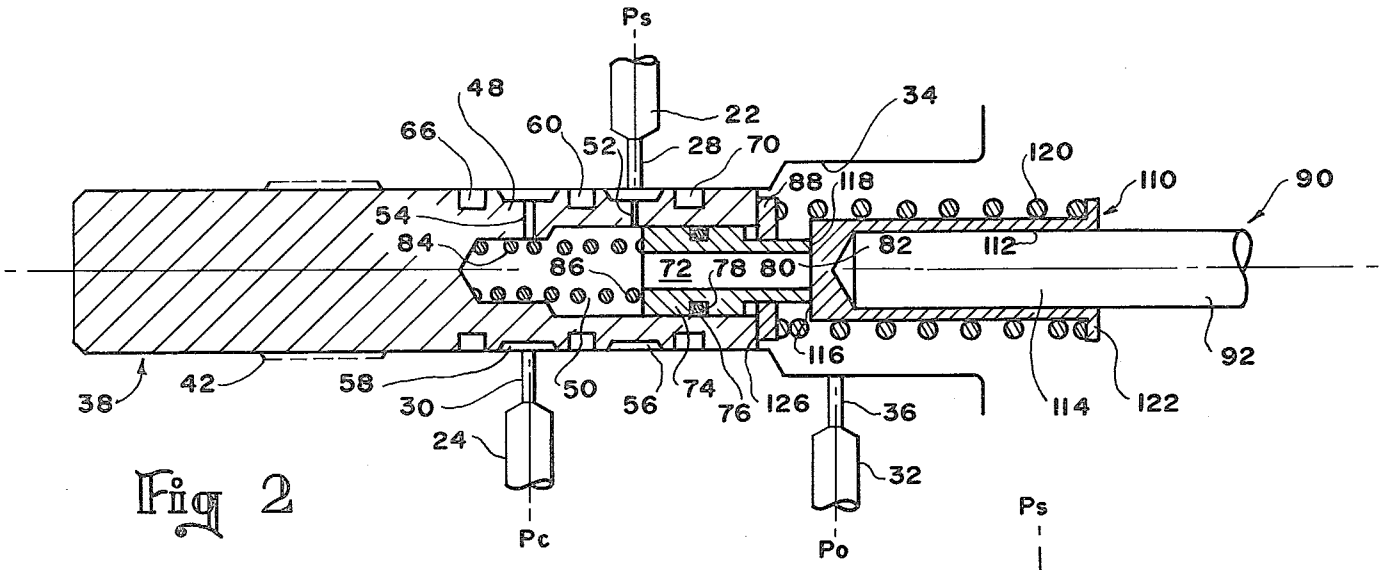
FIG. 2 is a cross-sectional view of a portion of the apparatus of FIG. 1 in a non-throttling position.
Figure 3:
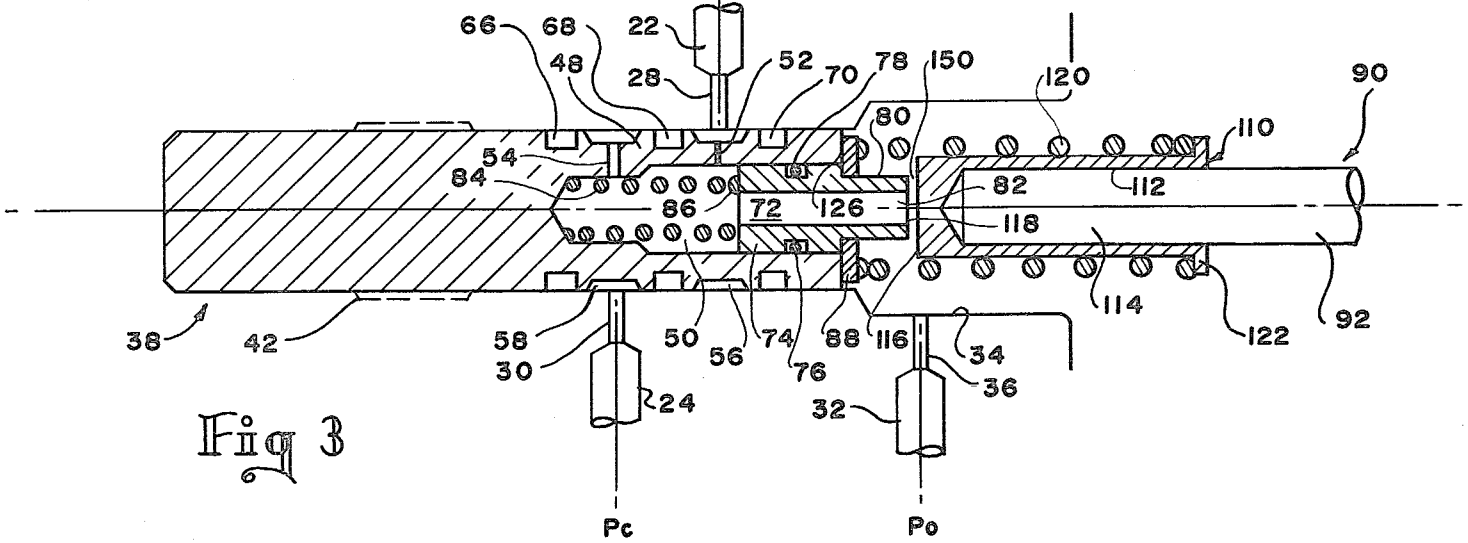
FIG. 3 is a cross-sectional view of a portion of the apparatus of FIG. 1 in a throttling position.
Figure 4:
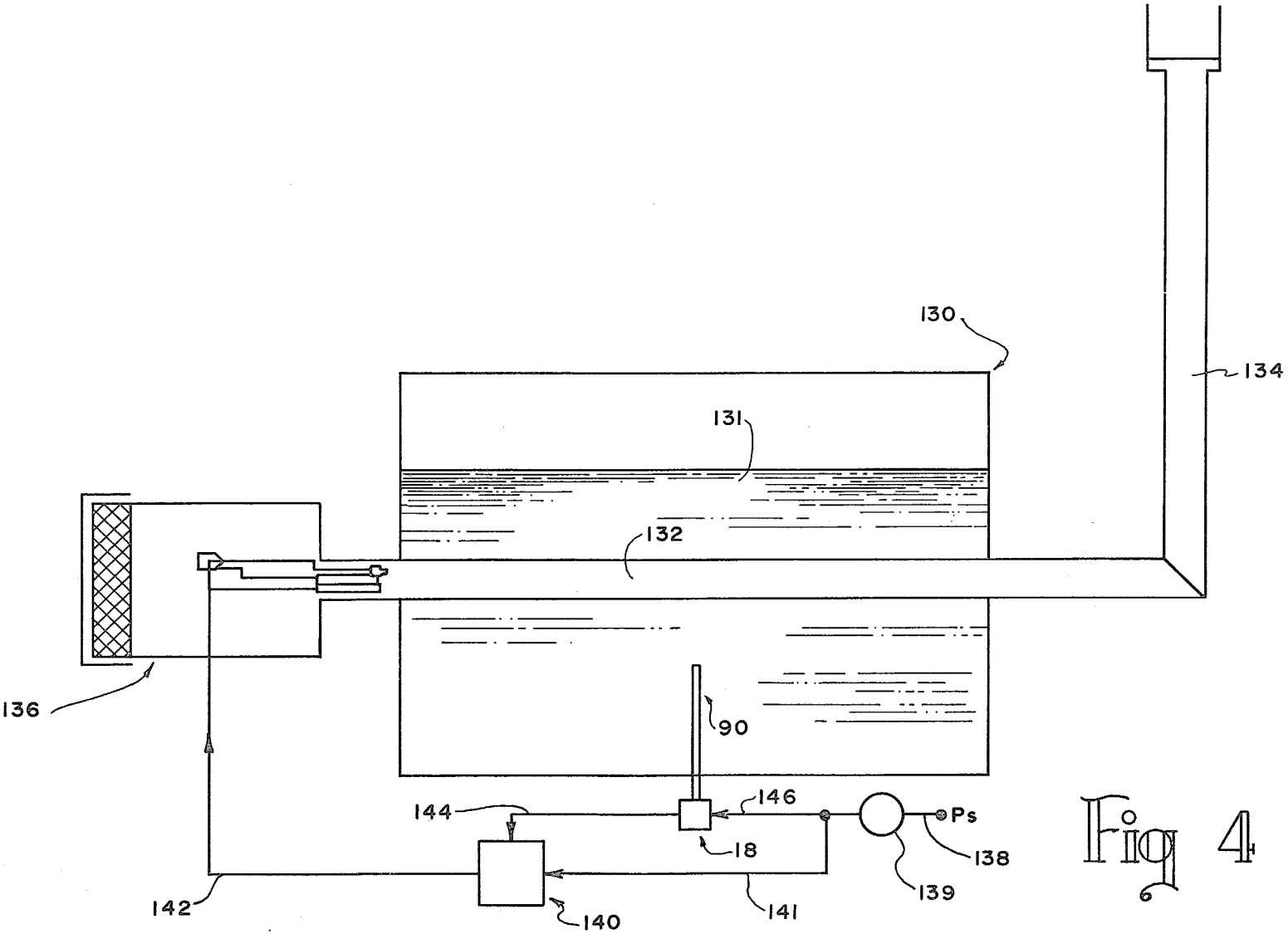

An illustrative example of use of the apparatus 18 of FIGS. 1–3 is shown in FIG. 4 in connection with a natural gas dehydrating system comprising a vessel 130 for containing a heated process fluid 131 such as glycol which is heated in the vessel by a fire tube 132 having an exhaust stack 134 at one end and a gas burner means 136 at the other end thereof. Gas burner means 136 receives natural gas from a supply line 138 through a conventional pressure regulator means 139, which maintains a substantially constant supply gas pressure, a supply gas line 141, a control gas-operated, diaphragm-type, motor valve throttling means 140, and a gas line 142. Valve means 140 is controlled by the pressure of control gas received from a supply line 144 after flowing through control apparatus 18 from supply gas line 146. Heat responsive tube means 90 is mounted inside vessel 130 so as to be surrounded by the heated process fluid therewithin.

In operation, the length of metal expansion tube 94 varies in accordance with the temperature of heated process fluid in vessel 130. As the metal expansion tube 94 expands and contracts, the longitudinal location of end plug 108 and abutment surface 106 thereof is varied whereby the position of control rod 92 is correspondingly varied because relatively high strength compression spring 120, acting through sleeve member 112, maintains the end surface 104 of rod member 92 in engagement with end surface 106 of plug member 108. Under normal continuous operating conditions at a preset nominal process fluid temperature of, for example 375° F., rod member 92 and sleeve 112 are displaced away from plunger member 80, as shown in FIG. 3, so that there is a variable size orifice gap 150 between plunger end surface 118 and sleeve end surface 116 whereby a controlled amount of supply gas in bore 50 flows through bore 82 to bore 34 and passages 36, 32 to reduce the pressure of gas flowing through passages 30, 24 to valve means 140 which controls the pressure and amount of gas delivered to the burner by throttling the gas flow therethrough. The construction and arrangement is such as to provide a limited control range in which the amount of gas delivered to the burner means 136 may be decreased or increased to accurately maintain the temperature of the process fluid in vessel means 130 within a relatively limited temperature range (e.g. 370° F. to 380° F.) above and below the predetermined set temperature of 375° F. Plunger member 72 normally abuts washer member 88 but, under abnormal low temperature operating conditions, is slidably movable in bore 50 against compression spring 84 to prevent damage to the apparatus. The set temperature, control range and temperature range may be adjustably varied by manually turning threaded stem member 38 to cause axial displacement of plunger member 72 and washer member 88 toward and away from sleeve member 110.

Figure 5:
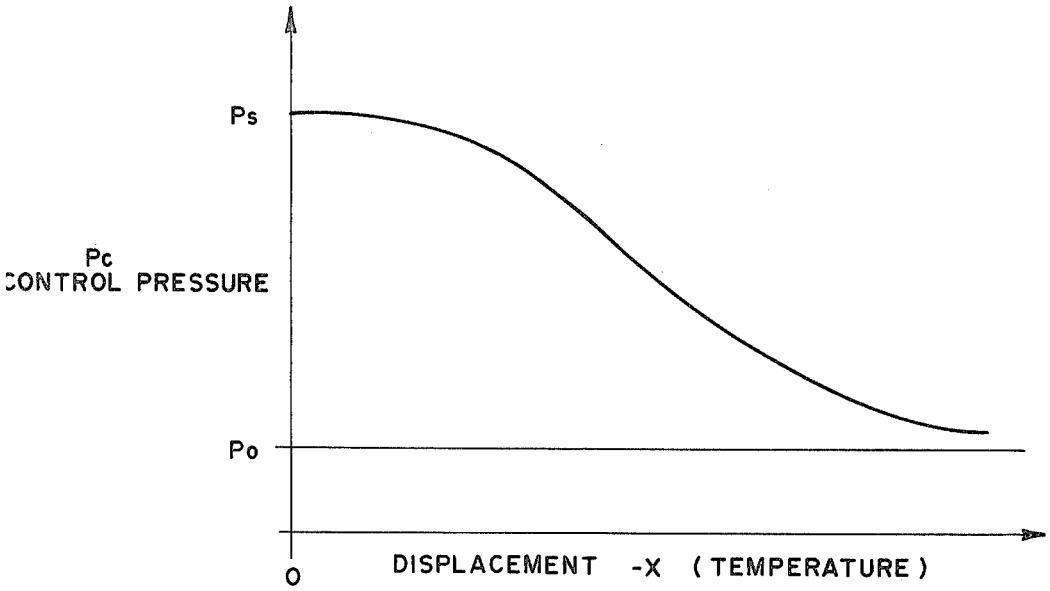
FIG. 5 is a graph showing the relationship between pressure of control gas and axial displacement of parts of the apparatus of FIG. 1.

FIG. 3 illustrates the action of the apparatus in a nominal control position where sleeve end surface 116 is separated from plunger end surface 118 by a variable distance x. As the distance x increases, the ratio of the area $A_3$ of vent orifice 150 over the fixed area $A_1$ of inlet orifice 52 increases. FIG. 5 illustrates the variation of the control gas pressure (Pc) in passage 24 with the distance x. It may be noted that with x=o when plunger axial bore 82 is shut by the sleeve end surface 116, the control gas pressure Pc in passage 24 equals the supply gas pressure Ps in passage 22. For large values of x, Pc asymptotically approaches vent pressure (Po); thus, the device has no true pressure cut-off in normal operation. An approximate mathematical model for non-dimensional (*) control pressure Pc* (Pc*=Pc/Ps) as a function of non-dimensional variable orifice area $A_3$* ($A_3$*=$A_3/A_1$) and non-dimensional vent pressure Po* (Po*=Po/Ps) is as follows:

$$Pc^* = \frac{Pc}{Ps} = \frac{1 + A_3^{*2} \cdot Po^*}{(A_3^{*2} + 1)}$$

If we let the vent pressure be at atmospheric and if Pc and Ps are defined in gage pressure, then Po*=0 and Pc* may be written (simplified) to:

$$Pc^* = \frac{1}{A_3^{*2} + 1)} = \frac{Pc}{Ps} \text{ (gage pressures).}$$

It is noted that $x = l_r$ ($\mu$ tube$-\mu$ rod) $\Delta T$ where $l_r$=length of low expansion rod; $\mu$ tube=thermal expansion coefficient of high expansion tube; $\mu$ rod=thermal expansion coefficient of low expansion rod; and $\Delta T$=temperature change. From the mathematical model given above, note that to have high sensitivity, that is a large change in Pc for a small temperature change, $A_3$ must change rapidly as a function of x, relative to $A_1$. This is accomplished by making the bore 82 of plunger 72 a rrelatively large diameter, e.g., approximately 0.10 inch such that a very small variation in distance x will produce a large change in $A_3$ relative to $A_1$. By properly sizing $A_1$, the plunger bore 82, and end surface diameter, a Pc versus x (temperature) curve may be tailored to the desired need.

FIG. 2 illustrates an important feature of the present invention in the condition where the burner has been shut off and the system is cooled down out of the thermostat control range. The high expansion tube 94 has now shortened so much relative to the low expansion rod 92 that the plunger 72 has been pushed out of contact with the plunger washer 88 by the sleeve 110. Without this feature, the device could be mechanically damaged during cold shut down. When the burner is relighted, the system will heat back up until the plunger 72 again contacts the plunger washer 88 thus stopping further axial movement of the plunger. Further temperature increase will cause the sleeve 110 to be displaced away from the end 118 of the plunger by a variable distance x. As x increases (temperature increases) the control pressure Pc will decrease as generally indicated in FIG. 5 until a stable steady state or "throttled" condition is reached.

Figure 7:
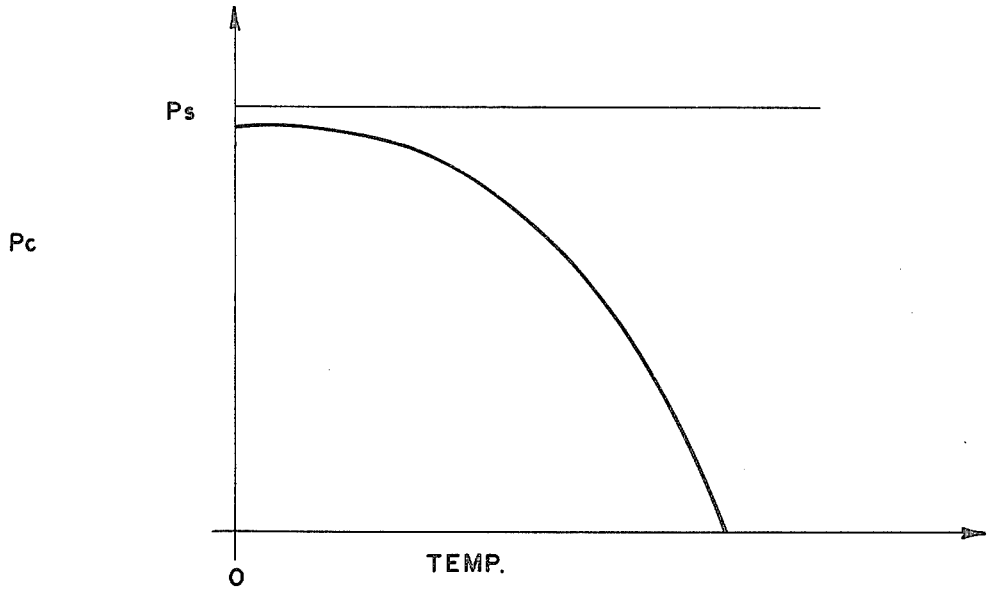
FIG. 7 is a graph showing the relationship between pressure of control gas and temperature for the apparatus of FIG. 6.
Figure 6:
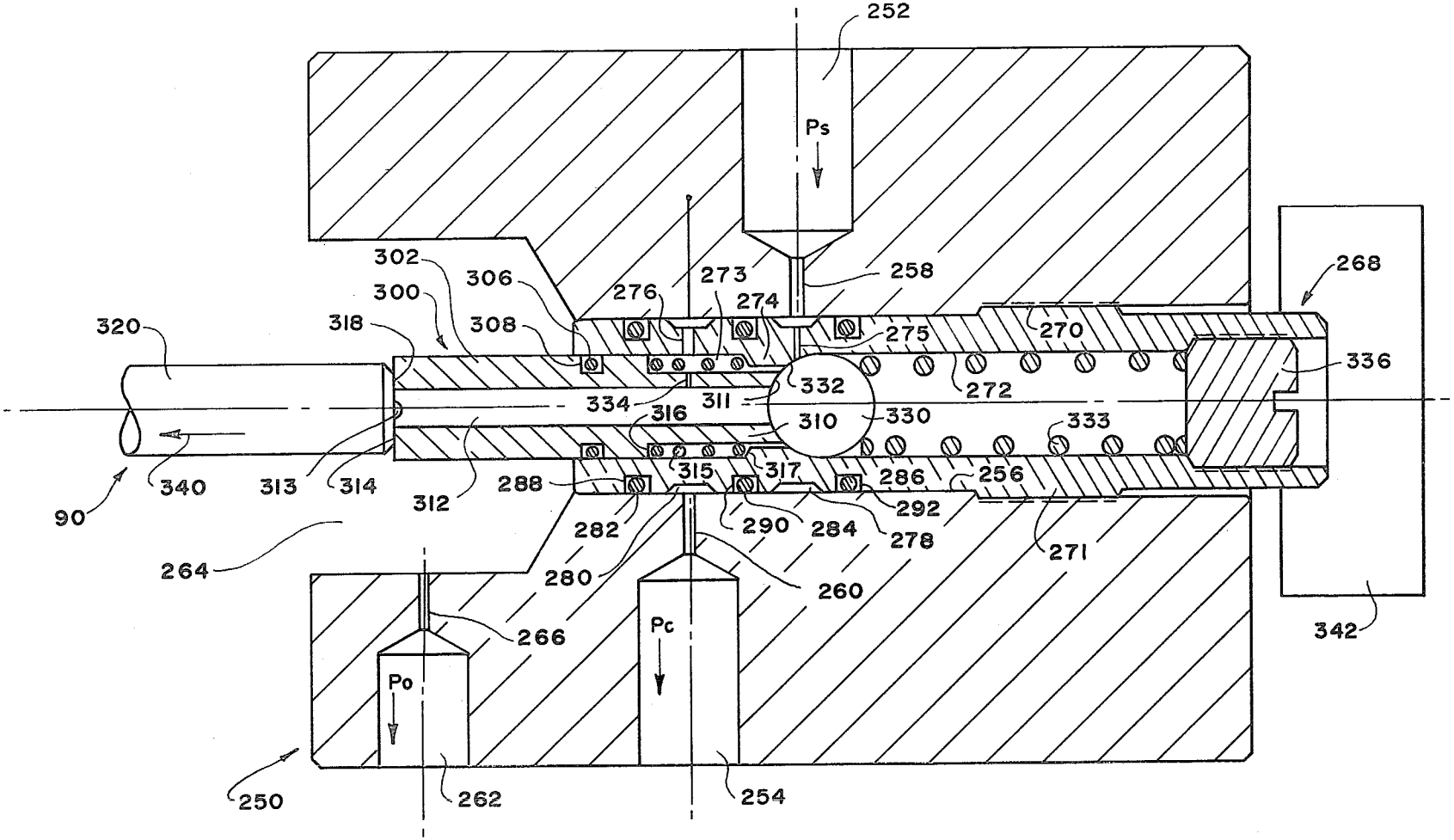
FIG. 6 is a cross-sectional view of a portion of an alternative embodiment of the invention.

FIG. 6 shows the primary working parts of a modified version of the apparatus of FIG. 4. The purpose of the modification is to change the output pressure versus temperature characteristic curve to the form shown in FIG. 7. The advantages of this modified version are twofold: first, it is possible to have a steeper Pc versus temperature action where so required, approaching a snap action; and second, this version provides a positive Pc cutoff above the control temperature.

In general, the control apparatus of FIG. 6 comprises a valve housing means 250 having a supply gas (Ps) inlet passage 252 and a control gas (Pc) outlet passage 254 which are connected to a central cylindrical bore 256 by relatively small diameter passages 258, 260. A gas vent passage 262 is connected to an enlarged counterbore portion 264 of bore 256 by a relatively small diameter passage 266. A main cylindrical valve stem member 268 is adjustably threadably mounted in a threaded bore portion 270 by a threaded stem portion 271 to enable longitudinal adjustment of stem member 268. The stem member has a pair of central cylindrical bores 272, 273 separated by an annular rib portion 274 which are connected to gas passages 258, 260 by longitudinally spaced passages 275, 276, respectively, and circumferential gas grooves 278, 280, respectively. O-ring seals 282, 284, 286 are mounted in peripheral seal grooves 288, 290, 292, respectively, longitudinally adjacent gas grooves 278, 280.

A plunger member 300 has a cylindrical outer end portion 302 slidably mounted in bore 273 in stem member 268 with an O-ring seal 306 mounted in a peripheral groove 308, and a cylindrical inner end portion 310 of reduced diameter having a spherical valve seat 311 at the end thereof. A central cylindrical passage 312 extends through plunger member 300 and a semi-cylindrical cross passage 313 extends across end surface 314. A relatively low strength compression spring member 315 is mounted in bore 273 with one end abutting plunger shoulder surface 316 and the other end abutting rib shoulder 317 to outwardly bias plunger member 300 into abutting engagement with end surface 318 of movable rod member 320. The amount of gas which flows though plunger bore 312 to bore 264 and passages 262, 266 is controlled by the linearly movable heat responsive means 90, FIG. 1, including cylindrical rod member 320 as previously described. Cross slot 313 at outer end surface 314 of plunger member 300 provides constant communication between bore 312 and bore 264. A ball valve member 330 is mounted in bore 272 for movement relative to a spherical valve seat 332 on annular rib 274 and valve seat 311 on plunger 300. A relatively strong compression spring 333 is mounted in bore 272 between ball valve member 330 and an end plug member 336 to bias the member 330 toward valve seat 332 and plunger valve seat 311. A relatively small diameter bleed passage 334 provides an orifice type connection between plunger bore 312 and control gas passages 254, 260.

In operation, as temperature of the process fluid 131 in vessel 130, FIG. 4, increases, rod 320 moves away from valve housing 250 as indicated by arrow 340, FIG. 6. At a predetermined high temperature condition in vessel 130, ball valve 330 is seated on valve seat 332, as shown in FIG. 6, to prevent flow of control gas from passages 252, 258 to passages 254, 260. As plunger 300 moves outwardly away from ball valve 330, valve seat 311 is disengaged from ball valve 330 to provide a passage therebetween connecting bore 273 to plunger bore 312 whereby regulator control gas in passage 254 will be vented through passage 260, groove 280, passage 276, bore 273, bore 312, cross-passage 313, bore 264, passage 266, and passage 262 to cause actuation of flow regulator 140, FIG. 4, to stop flow of supply gas to burner 136. During normal operation within a predetermined range of temperature conditions in vessel 130, rod 320 forces plunger member 300 inwardly to establish contact between seat 311 and ball valve 330 resulting in gradual movement of ball valve 330 away from valve seat 332 to provide a variable size orifice passage therebetween which increases in size as vessel temperature decreases and decreases in size as vessel temperature increases. When ball valve 330 is spaced from seat 332, control gas flows into bore 273 and through passage 276, groove 280, passage 260, and passage 254 to flow regulator 140. At the same time, a portion of the control gas in bore 273 is vented through orifice passage 334, bore 312, cross passage 313, bore 264, passage 266 and passage 262. The axial position of stem member 268 relative to plunger 300 may be varied by turning a hand knob 342 attached to stem member 268.

Whenever rod 320 pushes the plunger 300 inwardly so as to slightly unseat the movable ball 330 relative to valve seat 332, high pressure supply gas (Ps) from line 252 flows into bore 273. The control pressure (Pc) increases as the distance x between valve 330 and valve seat 332 increases (temperature decreases) and asymptotically approaches Ps (see FIG. 7). Increases in temperature cause the distance x to decrease so that the annular control area between the movable ball 330 and the ball seat 332 decreases. This action causes the control pressure to decrease. When the ball 330 finally seats, the control pressure becomes zero or vent pressure. The device can be made to approach snap action by deleting the optional bleed hole 334.

While alternative and illustrative embodiments of the invention have been shown and described herein, it is intended that the appended claims be construed to include other embodiments except insofar as limited by the prior art.

The invention claimed is:

1. A system for controlling the amount of natural supply gas delivered from a natural gas supply source to a natural gas burner adapted to continuously heat a process fluid in a vessel and for enabling the gas burner to continuously automatically maintain the temperature of the process fluid within a predetermined minimum range of temperatures above and below a pre-set nominal temperature which comprises:

supply gas line means for delivering supply gas to the gas burner;

a gas operated flow regulator means associated with said supply gas line means for regulating the amount of supply gas delivered to the gas burner in accordance with the pressure of control gas delivered to said regulator means;

control gas line means in fluid communication at one end thereof with said supply gas line means and in fluid communication at the other end thereof with said flow regulator means for delivering control gas to said flow regulator means;

a pressure control means in fluid communication with said control gas line means and said supply gas line means for controlling the pressure of the control gas delivered to said regulator means;

a thermostatically controlled actuating means operable in accordance with the temperature of the process fluid in the vessel and being operably associated with said pressure control means for continuously variably controlling the pressure of control gas delivered to said flow regulator means in accordance with the temperature of the process fluid whereby the amount of supply gas delivered to the burner is increased when process fluid temperature falls below the set nominal temperature and is decreased when process fluid temperature rises above the set nominal temperature;

said pressure control means comprising:

a valve housing device;

a central bore in said housing device;

a valve stem member mounted in said central bore in said housing device;

a central bore in said valve stem member having an open end portion and an opposite closed end portion;

a plunger member mounted in said central bore in said valve stem member;

said central bore in said valve stem member and said plunger member defining a gas chamber;

a gas vent passage means connected to one end of said central bore in said housing device for venting gas from said gas chamber and changing the pressure of the gas delivered to said flow regulator means;

a spring means mounted in said gas chamber in said central bore in said valve stem member and being operably engaged with said plunger member for biasing said plunger member toward the open end of said central bore in said valve stem member;

a control gas inlet passage means extending through said valve housing device and said central bore in valve housing member and said valve stem member to said gas chamber for supplying control gas to said gas chamber from said supply gas line means;

said gas inlet passage means including a fixed relatively small size orifice;

a control gas outlet passage means extending from said gas chamber through said valve stem member and said central bore in said valve housing device and said valve housing device to a control gas line connected to said flow regulator means for delivering control gas to said flow regulator means;

a central bore extending through said plunger member and having an inlet opening and an outlet opening for connecting said gas chamber to said vent passage means;

a vent gas flow control means for movement between a closed, non-throttling position relative to said central bore in said plunger member, whereat the flow of gas from said gas chamber to said vent gas passage means is precluded to provide a maximum control gas pressure condition in said control gas line; and a plurality of open control gas pressure varying positions variably axially spaced relative to said central bore in said plunger member; whereby to provide a relatively large variable size vent orifice to enable variable amounts of gas to flow from said gas chamber to said vent passage means to variably decrease and increase control gas pressure;

said thermostatically controlled actuating means being operatively associated with said vent gas control means for causing variable axial displacement of said vent gas control means relative to said central bore in said plunger member.

2. The invention as defined in claim 1 and wherein said thermostatically controlled actuating means comprises:

an elongated tubular outer member made of a material having a relatively high coefficient of expansion;

said elongated tubular outer member having an open end portion fixedly mounted on said valve housing device adjacent said vent gas flow control means;

a closed opposite end portion;

an elongated inner member made of a material having a relatively low coefficient of expansion mounted in said elongated tubular outer member in a manner enabling relative movement therebetween;

said elongated inner member having one end portion located adjacent said outlet opening of said central bore in said plunger member and an opposite end portion located adjacent said closed opposite end portion of said elongated tubular outer member;

a relatively high strength spring means operatively associated with said one end portion of said elongated inner member for biasing said other end portion of said elongated inner member into abutting association with said closed opposite end portion of said elongated tubular outer member whereby movement of said elongated inner member is controlled by expansion and contraction of said elongated tubular outer member in response to changes in temperature of the process fluid in the vessel;

said vent gas flow control means being operatively associated with and movable relative to said plunger member by said one end portion of said elongated inner member.

3. The invention as defined in claim 2 and wherein said vent gas flow control means comprises:

a sleeve means mounted on and movable by said one end portion of said elongated inner member and having an end surface means for engaging said plunger member and closing said outlet opening in said central bore in the closed non-throttling position and for being variably axially spaced therefrom in the variably axially spaced positions.

4. The invention as defined in claim 3 and wherein:

said relatively high strength spring means being mounted between said sleeve means and said elongated outer tubular member with one end portion abutting said sleeve means and another opposite end portion being supported by said stem member.

5. The invention as defined in any of claims 1–4 and wherein:

one end portion of said plunger member being of reduced diameter relative to the other end portion thereof;

a washer member mounted on said one end portion of said plunger member to enable relative axial movement therebetween and having an outer diameter such as to enable sliding movement within said central bore of said housing device;

one side surface of said washer member engaging said opposite end portion of said relatively high strength spring means and an opposite side surface of said washer member being held in abutting engagement with said stem member by the force of said relatively high strength spring means.

6. The invention as defined in claim 5 and wherein:

said plunger member being slidably movable away from said washer member in said central bore of said stem member against the bias of said relatively low strength spring means by force applied from said inner elongated member under abnormal operating conditions.

7. The invention as defined in claim 1 and wherein said vent gas flow control means comprises:

a ball valve member mounted in said central bore in said valve stem member;

an annular valve seat means in said central bore in said valve stem member located downstream of said relatively small fixed size orifice for abutting engagement with said ball valve member in the closed non-flow position and having a central annular flow passage extending therethrough which is closed when said ball valve member is seated on said valve seat means;

said relatively high strength spring means being mounted between said ball valve member and said other closed end portion of said central bore in said stem member so as to bias said ball valve member toward the closed non-flow position;

said plunger member being mounted between said ball valve member and said open end portion of said central bore in said valve stem member with one end portion of said plunger member being operatively engageable with said thermostatically controlled actuating means and another opposite end portion of said plunger member having a valve seat engageable with said ball member to close one end of said central bore in said plunger member in the throttling position while at the same time providing force transfer means between said ball valve member and said plunger member for enabling transfer of force therebetween in the throttling position, said valve seat being disengageable from said ball valve member in the closed non-flow position to open said one end of said central bore in said plunger member; and said annular valve seat means and said ball valve member defining a variable relatively large size orifice therebetween in the open throttling position.

8. The invention as defined in claim 7 and further comprising:

bleed hole passage means connecting said central bore in said stem member to said central bore in said plunger member; and an outlet passage means to said enlarged counterbore in said housing device.

9. The invention as defined in claims 1, 7 or 8 and wherein said thermostatically controlled actuating means comprises:

an elongated tubular outer member made of a material having a relatively high coefficient of expansion;

said elongated tubular outer member having an open end portion fixedly mounted on said valve housing device adjacent said vent gas flow control means and an axially outwardly spaced opposite end portion;

an elongated inner member made of a material having a relatively low coefficient of expansion operatively connected to said elongated tubular outer member whereby movement of said elongated inner member is controlled by expansion and contraction of said elongated tubular outer member in response to changes in temperature of the process fluid in the vessel;

said elongated inner member having one end portion located adjacent said outlet opening of said central bore in said plunger member and being operably connected to said plunger member whereby movement of said elongated inner member causes corresponding movement of said plunger member.

10. A system for controlling the amount of natural supply gas delivered from a natural gas supply source to a natural gas burner adapted to continuously heat a process fluid in a vessel and for enabling the gas burner to continuously automatically maintain the temperature of the process fluid within a predetermined minimum range of temperatures above and below a pre-set nominal temperature which comprises:

supply gas line means for delivering supply gas to the gas burner;

a gas operated flow regulator means associated with said supply gas line means for regulating the amount of supply gas delivered to the gas burner in accordance with the pressure of control gas delivered to said regulator means;

control gas line means in fluid communication at one end with said supply gas line means and in fluid communication at the other end with said flow regulator means for delivering control gas to said flow regulator means;

a control gas flow control means in fluid communication with said control gas line means and said supply gas line means including a continuously variable adjustable valve means movable between a plurality of adjusted variably open positions during continuous operation of the gas burner for enabling continuous flow of variable amounts of control gas through said control gas flow control means to said gas operated flow regulator means to variably increase and decrease control gas pressure in said gas operated flow regulator means during continuous operation of the burner means whereby the amount of supply gas delivered to the gas burner is continuously variable during continuous operation of the gas burner to continuously automatically maintain the temperature of the process fluid within the predetermined minimum range of temperatures above and below the present nominal temperature; and a thermostatically controlled actuating means operable in accordance with the temperature of the process fluid in the vessel and being operably associated with said control gas flow control means for continuously variably controlling the pressure of control gas delivered to said flow regulator means in accordance with the temperature of the process fluid whereby the amount of supply gas delivered to the burner is increased when process fluid temperature falls below the set nominal temperature and is decreased when process fluid temperature rises above the set nominal temperatures;

wherein said control gas flow control means and said valve means comprise:

a control gas chamber means for receiving control gas from said control gas line means;

a gas vent passage means connected to said control gas chamber means for venting control gas from said gas chamber means and changing the pressure of the gas delivered to said flow retulator means;

a control gas inlet passage means connected to said gas chamber means for supplying control gas to said gas chamber means from said supply gas line means;

said gas inlet passage means including a fixed relatively small size orifice;

a gas outlet passage means extending from said gas chamber means to a control gas outlet line connected to said flow regulator means for delivering control gas to said flow regulator means;

said continuously variable adjustable valve means defining a portion of said gas chamber means and being movable between a closed, non-throttling position relative to said vent passage means whereat flow of control gas from said gas chamber means to said vent gas passage means is precluded to provide a maximum control gas pressure condition in said control gas line, and a plurality to open control gas pressure varying positions whereby to provide a relatively large variable size vent orifice to enable variable amounts of gas to flow from said gas chamber means to said vent passage means to variably decrease and increase control gas pressure;

wherein said control gas flow control means and said valve means further comprise:

a valve housing device;

a central bore in said housing device;

a valve stem member mounted in said central bore in said housing device;

a central bore in said valve stem member having an open end portion and an opposite closed end portion;

a plunger member mounted in said central bore in said valve stem member;

said central bore in said valve stem member and said plunger member defining said gas chamber means;

said gas vent passage means being connected to one end of said central bore in said housing device for venting gas from said gas chamber means and changing the pressure of the gas delivered to said flow regulator means;

a spring means mounted in said gas chamber means in said central bore in said valve stem member and being operably engaged with said plunger member for biasing said plunger member toward the open end of said central bore in said valve stem member;

said control gas inlet passage means extending through said valve housing device and said central bore in valve housing member and said valve stem member to said gas chamber means for supplying control gas to said gas chamber means from said supply gas line means;

said control gas outlet passage means extending from said gas chamber means through said valve stem member and said central bore in said valve housing device and said valve housing device to said control gas outlet line for delivering control gas to said flow regulator means;

a central bore extending through said plunger member and having an inlet opening and an outlet opening for connecting said gas chamber means to said vent passage means;

said valve means being movable between a closed, non-throttling position relative to said central bore in said plunger member, whereat flow of gas from said gas chamber means to said vent gas passage means is precluded to provide a maximum control gas pressure condition in said control gas line, and a plurality of open control gas pressure varying positions variably axially spaced relative to said central bore in said plunger member whereby to provide a relatively large variable size vent orifice to enable variable amounts of gas to flow from said gas chamber means to said vent passage means to variably decrease and increase control gas pressure;

said thermostatically controlled actuating means being operatively associated with said valve means for causing variable axial displacement of said valve means relative to said central bore in said plunger member.

11. The invention as defined in claim 10 and wherein said valve means further comprises:

a ball valvve member mounted in said central bore in said valve stem member;

an annular valve seat means in said central bore in said valve stem member located downstream of said relatively small fixed size orifice for abutting engagement with said ball valve member in the closed non-flow position and having a central annular flow passage extending therethrough which is closed when said ball valve member is seated on said valve seat means;

a relatively high strength spring means being mounted between said ball valve member and said other closed end portion of said central bore in said stem member so as to bias said ball valve member toward the closed non-flow position;

said plunger member being mounted between said ball valve member and said open end portion of said central bore in said valve stem member with one end portion of said plunger member being operatively engageable with said thermostatically controlled actuating means and another opposite end portion of said plunger member having a valve seat engageable with said ball member to close one end of said central bore in said plunger member in the throttling position while at the same time providing force transfer means between said ball valve member and said plunger member for enabling transfer of force therebetween in the throttling position, said valve seat being disengageable from said ball valve member in the closed non-flow position to open said one end of said central bore in said plunger member;

said annular valve seat means and said ball valve member defining said variable relatively large size orifice therebetween in the open throttling position.

12. The invention as defined in claim 11 and wherein said thermostatically controlled actuating means comprises:

an elongated tubular outer member made of a material having a relatively high coefficient of expansion;

said elongated tubular outer member having an open end portion fixedly mounted on said valve housing device adjacent said vent gas flow control means and an axially outwardly spaced opposite end portion;

an elongated inner member made of a material having a relatively low coefficient of expansion operatively connected to said elongated tubular outer member whereby movement of said elongated inner member is controlled by expansion and contraction of said elongated tubular outer member in response to changes in temperature of the process fluid in the vessel;

said elongated inner member having one end portion located adjacent said outlet opening of said central bore in said plunger member and being operably connected to said plunger member whereby movement of said elongated inner member causes corresponding movement of said plunger member.

* * * * *